US005735110A

United States Patent [19]

Krüger et al.

[11] Patent Number: 5,735,110

[45] Date of Patent: Apr. 7, 1998

[54] CORE YARN WITH A CORE OF HIGH STRENGTH POLYESTER MATERIAL, PRODUCTION THEREOF AND USE OF SELECTED POLYESTER MATERIAL FOR PRODUCING CORE YARNS

[75] Inventors: Erhard Krüger; Aribert Reinsch, both of Bobingen; Sigmar Hartmann, Bad Hersfeld, all of Germany

[73] Assignee: Hoechst Aktiengesellschaft, Germany

[21] Appl. No.: 819,303

[22] Filed: Mar. 18, 1997

Related U.S. Application Data

[63] Continuation of Ser. No. 520,716, Aug. 29, 1995, abandoned, which is a continuation of Ser. No. 131,290, Oct. 4, 1993, abandoned.

[51] Int. Cl.[6] ..... D02G 3/02; D02G 3/06

[52] U.S. Cl. ..... 57/224; 57/903

[58] Field of Search ..... 57/3, 5, 210, 235, 57/224, 903

[56] References Cited

U.S. PATENT DOCUMENTS

| | | | |
|---|---|---|---|
| 3,410,078 | 11/1968 | Freeman et al. | 57/903 |
| 3,828,544 | 8/1974 | Alicer | 57/210 |
| 4,024,895 | 5/1977 | Barron | 57/210 |
| 4,036,003 | 7/1977 | Lowder et al. | 57/903 |
| 4,191,211 | 3/1980 | Boyer | 57/210 |
| 4,191,221 | 3/1980 | Boyer | 57/210 X |
| 4,343,334 | 8/1982 | Schulze et al. | 57/5 |
| 5,100,729 | 3/1992 | Jacob et al. | 420/370 |
| 5,344,710 | 9/1994 | Jacob et al. | 428/370 |

FOREIGN PATENT DOCUMENTS

| | | |
|---|---|---|
| 0 173 200 | 3/1986 | European Pat. Off. . |
| 0 241 857 | 12/1990 | European Pat. Off. . |
| 1 155 040 | 9/1963 | Germany . |
| 75 37 019 | 3/1976 | Germany . |
| 24 36 997 | 6/1976 | Germany . |
| 24 36 997 C2 | 8/1982 | Germany . |
| 34 31 832 A1 | 3/1986 | Germany . |

*Primary Examiner*—William Stryjewski
*Attorney, Agent, or Firm*—Connolly & Hutz

[57] ABSTRACT

In core yarns, a) the polyester material of the core filaments has an average molecular weight corresponding to a relative solution viscosity of at least 1.9, and b) the core has a specific strength of at least 60 cN/tex, the core yarns producing a seam length to rupture of more than 800 cm in a sewing test under aggravated conditions.

The core yarns are obtainable by a process comprising the measures of: i) producing multifilament yarns based on polyesters having an average molecular weight corresponding to a relative solution viscosity of at least 1.9 by melt spinning polyester with a takeoff speed of at least 1500 m/min. and subsequently drawing under conditions such that the yarn has a breaking extension of about 15% and a breaking strength which corresponds to the maximum breaking strength obtainable for the yarn in question or is up to 30% below that value, and ii) sheathing this multifilament yarn with fibers of vegetable, regenerated or synthetic origin or mixtures thereof in a conventional manner in such a way that the multifilament yarn is virtually completely covered.

14 Claims, 1 Drawing Sheet

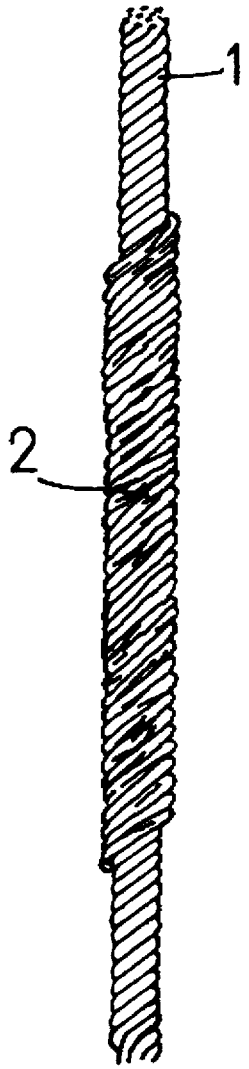
1
2

CORE YARN WITH A CORE OF HIGH STRENGTH POLYESTER MATERIAL, PRODUCTION THEREOF AND USE OF SELECTED POLYESTER MATERIAL FOR PRODUCING CORE YARNS

CROSS-REFERENCE TO RELATED APPLICATIONS

The present application is a continuation of application Ser. No. 08/520,716, filed Aug. 29, 1995, now abandoned, which in turn is a continuation of application Ser. No. 08/131,290, filed Oct. 4, 1993, now abandoned.

BACKGROUND OF THE INVENTION

The present invention relates to novel core yarns, which contain a selected core material, to adapted processes for producing them, and to the use of selected polyester materials for producing core yarns.

Core yarns are known per se and are used in particular as sewing threads. Sewing threads of this type usually comprise one or more core yarns, each of which comprises a filamentary core made of a synthetic material and sheathed, by spinning, with fibers of vegetable, regenerated or synthetic origin or mixtures thereof in such a way with simultaneous twisting that the core is virtually completely covered. Core yarns of this type are known for example from DE-B-1,550,040, DE-U-75-37,019 DE-A-2,436,997 and EP-A-241,857.

In these prior art core yarns, the filamentary cores are made of a high strength synthetic material, while the sheathing generally makes no significant contribution to the strength of the yarn. The sheathing serves primarily to protect the core material from overheating when subjected to high mechanical stress, for example when used in industrial sewing machines.

Various core materials have been proposed for core yarns. For instance, DE-A-2,436,997 and EP-A-241,857 disclose high strength polyester filaments.

Furthermore, EP-A-173,200 discloses multifilament feed yarns for sewing yarns, produced from macro-molecular polyester material by high speed spinning and drawing to a high draw ratio. The production of core yarns from said material is not explicitly mentioned. The feed yarns known from this publication can be processed into sewing threads which have a long sewn length under aggravated conditions and also have a high seam strength.

In the train of the continuing improvement in the productivity of industrial sewing machines, which is reflected inter alia in a higher number of stitches per unit time and/or in improved machine speeds, there is a need for sewing threads which can be used under aggravated sewing conditions and whose rupture rate is very low. Furthermore, the seam produced must be strong.

SUMMARY OF THE INVENTION

The present invention makes available a sewing yarn having the desired property profile.

The present invention accordingly provides a core yarn comprising at least one filamentary core made of a polyester material and sheathed with fibers of vegetable, regenerated or synthetic origin or mixtures thereof in such a way that the core is virtually completely covered, wherein a) the polyester material of the core filaments has an average molecular weight corresponding to a relative solution viscosity (determined on solutions of 1 g of polyester in 100 ml of dichloroacetic acid at 25° C.) of at least 1.9, and b) the core has a specific strength of at least 60 cN/tex, this core yarn producing a seam length to rupture of more than 800 cm in a sewing test under aggravated conditions, said sewing test being carried out on four plies of cotton twill of basis weight 350 g/m$^2$ with 5000 stitches/min, four stitches/cm, a sewing tension of 220 cN and with sewing in the forward direction.

As used herein, the words "sheathed with fibers . . . in such a way that the core is virtually completely covered" are to be understood as meaning that the core is sheathed by the overwrapping fibers in such a way that, under sewing conditions, it undergoes virtually no change in respect of its mechanical properties and that in particular the linear and loop strengths/tenacities of the core material before and after sewing are essentially unchanged, for example decreasing by not more than 10%.

The term "specific strength" is the ratio of breaking strength to linear density at the instant of rupture.

BRIEF DESCRIPTION OF THE DRAWING

The single figure of drawing illustrates a sewing yarn of the present invention including a filamentary core 1 and a fiber sheathing 2.

DETAILED DESCRIPTION OF THE INVENTION

It has been found that the use in the production of core yarns of polyester multifilament yarn which has been spun at high speed and drawn to a high draw ratio leads to products which have not only the desired high yarn strength but also other advantageous application properties.

For instance, the core yarn obtained has excellent loop tenacities and shrinkage properties and produces seams of excellent strength.

The tenacity (measured by the method of DIN 53 834) of the core yarns according to the invention is usually more than 40 cN/tex, preferably from 42 to 46 cN/tex. The tenacity is the breaking strength divided by the use linear density of the total core yarn.

The loop tenacity (measured by the method of DIN 53 843) of the core yarns according to the invention is usually more than 29 cN/tex, preferably from 30 to 34 cN/tex.

The extension under a load of 300 cN (measured by the method of DIN 53 834) of the core yarns according to the invention is usually less than 3.5%, preferably from 2.8 to 3.2%.

The breaking extension (measured by the method of DIN 53 834) of the core yarns according to the invention is usually less than 20%, preferably from 16 to 19%. The breaking extension is the extension of the yarn at break.

The 180° C. hot air shrinkage (measured by the method of DIN 53 866 Part 3) of the core yarns according to the invention is usually less than 2%, preferably from 1.4 to 1.8%.

The favorable combination of properties, in particular of tensile and transverse strengths of the core material used according to the invention, leads to particularly good sewing properties.

These can be characterized by means of a specially developed testing method as described in DE-A-3,431,832—a sewing test on an industrial sewing machine under standardized conditions. The length of the seam produced provides information about the suitability of the yarn. The industrial sewing machine used is a Pfaff, and it is equipped with a needle Nm 90; a backstitch seam is sewn using four stitches per centimeter and a sewing speed of 5000 stitches per minute. The yarn tension is 220 cN. The work is a four-ply pile of cotton twill having a basis weight of 350 g/m$^2$ per ply and 33 warp and 20.5 weft threads per centimeter. It is in fact a standard fabric for workwear. The reported "sewn length" is the length of the seam in centimeters until the yarn broke and represents an average of ten runs per bobbin.

Under these test conditions the core yarns of the invention result on forward sewing in "sewn lengths" of more than 800 cm, preferably from 875 to 1050 cm.

The seam strength is a further parameter for evaluating the properties of sewing yarns. It is determined by using an industrial sewing machine, for example from Pfaff, at the above-specified machine setting. In this case the upper and lower threads are the same and are each a length of the core yarn according to the invention. The yarn tension is optimized for good seam appearance and a two-ply layer of cotton twill is sewn. The cotton twill used is the same material as used for determining the sewn length. The seam strength is the maximum tensile strength of a 5 cm wide strip. The tensile strength is determined in a tensile tester using an extension rate of 10 cm per minute.

The core yarns of the invention usually give seam strengths of more than 35 daN, preferably from 36 to 41 daN.

Preference is given to core yarns which have a final linear density of from 100 to 1500 dtex, in particular from 130 to 750 dtex.

The filamentary core of the core yarn according to the invention preferably has a linear density of from 45 to 300 dtex. If more than one core is present in the core yarn, this linear density is accordingly multiplied by the number of cores.

Preferably the core yarn according to the invention comprises two mutually twisted cores, which are in turn each sheathed with fibers of vegetable, regenerated or synthetic origin in such a way that the core is virtually completely covered.

The weight ratio of core to overwrapping fiber in the core yarn of the invention is usually from 30:70 to 50:50, preferably about 40:60.

Core and overwrapping fibers differ in general in their linear density. The core filaments usually have a linear density of from 2 to 10 dtex. The linear density of the overwrapping fibers is usually from 1 to 2 dtex in the case of polyester fibers.

The core material of the core yarn according to the invention is polyester of the above-indicated specifications. The core material is used in the form of multifilament yarns.

The overwrapping yarn of the core yarns according to the invention can in principle be composed of any desired fiber. Here the term "fiber" is to be understood in its widest sense, i.e. as continuous filament fiber or as staple fiber. Nor is the overwrapping yarn subject to any restrictions as regards its material. It is possible to use fibers in the widest sense of vegetable, regenerated or synthetic origin, provided they are suitable for conferring protection on the core during sewing.

Examples of fibers of vegetable origin are cotton fibers.

Examples of fibers of regenerated origin are cellulose fibers obtainable by the xanthate process.

Examples of fibers of synthetic origin are fibers made of synthetic spinnable polymers and polycondensation products, for example polyamides, polyacrylonitrile and in particular polyesters.

Suitable polyesters for the core material and optionally the overwrapping yarn are in particular those which are obtained essentially from aromatic dicarboxylic acids, for example 1,4-, 1,5- or 2,6-naphthalenedicarboxylic acid, isophthalic acid or in particular tetephthalic acid, and aliphatic diols of from 2 to 6, in particular from 2 to 4, carbon atoms, e.g. ethylene glycol, 1,3-propanediol or 1,4-butanediol, by cocondensation. It is also possible to use hydroxycarboxylic acids as starting materials for polyesters.

The abovementioned polyester raw materials may be modified by incorporation as cocondensed units of small amounts of aliphatic dicarboxylic acids, e.g. glutaric acid, adipic acid or sebacic acid, or of polyglycols, e.g. diethylene glycol (2,2'-dihydroxydiethyl ether), triethylene glycol (1,2-di(2-hydroxyethoxy)ethane) or else of minor amounts of higher polyethylene glycols.

Another option, which affects in particular the dyeing characteristics of the core yarns according to the invention, is to incorporate sulfo-containing units, for example sulfoisophthalic acid units.

The upper limit for the final tenacity of the core yarns according to the invention depends on the degree of condensation chosen for the polyester material used in the core material. The degree of condensation of the polymer is reflected in its viscosity. A high degree of condensation, i.e. a high viscosity, leads to particularly high final tenacities.

The polyesters used according to the invention as core materials have a relative solution viscosity (determined on solutions of 1 g of polyester in 100 ml of dichloroacetic acid at 25° C.) of at least 1.9.

Preference is given to using polyesters which have a relative solution viscosity of from 1.9 to 2.4, in particular from 1.95 to 2.1.

A preferred polyester material for producing the core and optionally the overwrapping yarn of the core yarns according to the invention is polyethylene terephthalate or a copolyester that contains recurring ethylene terephthalate units.

The cores of the core yarns according to the invention have a breaking strength of at least 60 cN/tex, preferably from 65 to 90 cN/tex.

Particular preference is given to the combination of polyester core and cotton overwrap.

To produce the core yarn of the invention, the core material used is a polyester multifilament yarn which was spun at high speed and then drawn to a high draw ratio to maximize its strength. The use of such high strength yarns spun at high speeds for producing core yarns has not been described before and, like the production of these yarns, comprises part of the subject-matter of the present invention.

The invention accordingly also provides a process for producing core yarns, comprising the measures of:

i) producing multifilament yarns based on polyesters having an average molecular weight corresponding to a relative solution viscosity (determined on solutions of 1 g of polyester in 100 ml of dichloroacetic acid at 25° C.) of at least 1.9 by melt spinning polyester with a takeoff speed of at least 1500 m/min, preferably from 1900 to 3200 m/min, and subsequently drawing under conditions such that the yarn has a breaking extension of about 15% and a breaking strength which corresponds to the maximum breaking strength obtainable for the yarn in question or is up to 30% below that value, and ii) sheathing this multifilament yarn with fibers of vegetable, regenerated or synthetic origin or mixtures thereof in a conventional manner in such a way that the multifilament yarn is virtually completely covered.

The high speed spun polyester multifilament yarn envisioned for use as the core material has a high orientation, which is reflected in a high birefringence. Typical values for the birefringence are within the range from $15\times10^{-3}$ to $40\times10^{-3}$.

After high speed spinning, the multifilament yarn is drawn to a high draw ratio to maximize its strength. It is known to the person skilled in the field of fiber production that there is a maximum obtainable strength, which depends on the chosen drawing temperature. To produce the core material of the invention, the high speed spun multifilament yarns have to be subjected to such drawing conditions, as drawing temperature and draw ratio, that the maximum strengths are obtained for the high speed spun multifilament yarn in question at a breaking extension of about 15%. This is also to be understood as including strengths which are up to 30% below the maximum value.

The spinning of the overwrapping yarn onto the core material can take place in a conventional manner. Processes for producing such sheaths are known for example from DE-A2.436.997.

The Examples which follow illustrate the invention without limiting it:

EXAMPLE 1

A polyethylene terephthalate multifilament yarn is produced by melt spinning and taken off at 2000 m/min. The polyethylene terephthalate used has a relative viscosity of 1.940. The high speed spun multifilament yarn, which has a birefringence of $18\times10^{-3}$, is then drawn at 75° C. to a ratio of 2.97:1 and then set. The setting temperature is 230° C. This multifilament yarn is used to produce a core yarn by spinning cotton onto it. Two of these core yarns are folded together to form a thread and then dyed. The properties of the individual production stages are listed in Table 1.

EXAMPLE 2 (comparative example)

Example 1 is repeated to produce a core yarn from polyester multifilament yarn and cotton, and to fold and dye it. However, in contradistinction to Example 1 the core material used is not a polyester multifilament yarn which has been spun at high speed but a commercially available high strength polyester multifilament yarn. The properties of the individual production stages are likewise listed in Table 1.

TABLE 1

| | | Example 1 | Example 2 |
|---|---|---|---|
| Multifilament: | | | |
| Linear density | dtex | 138.4 | 138.0 |
| Breaking strength | cN | 926 | 965 |
| Tenacity | cN/tex | 66.9 | 70.0 |
| Breaking extension | % | 12.8 | 17.0 |
| Extension at 45 cN/tex | % | 6.6 | 8.2 |
| Loop tenacity | cN/tex | 42.8 | 40.2 |
| Hot air shrinkage 200° C. | 5 | 7.9 | 7.0 |
| Core yarn/cotton | | | |
| Yarn count | Nm | 48.7 | 48.0 |
| Linear density | dtex | 205.2 | 208.0 |
| Breaking strength | cN | 891 | 894 |
| Tenacity | cN/tex | 43.4 | 43.0 |

TABLE 1-continued

| | | Example 1 | Example 2 |
|---|---|---|---|
| Breaking extension | % | 14.6 | 17.1 |
| Raw thread: | | | |
| Twist S | T/m | 780 | 780 |
| x 2 z | T/m | 640 | 690 |
| Linear density | d/tex | 411.5 | 424.0 |
| Breaking strength | cN | 1904 | 1952 |
| Tenacity | cN/tex | 46.3 | 46.0 |
| Breaking extension | % | 14.2 | 18.4 |
| Hot air shrinkage 180° C. | % | 5.8 | 4.3 |
| Dyed thread: | | | |
| Linear density | dtex | 421.8 | 425.0 |
| Breaking strength | cN | 1840 | 1858 |
| Tenacity | cN/tex | 43.7 | 43.7 |
| Breaking extension | % | 18.8 | 21.2 |
| Extension at 300 cN | % | 3.1 | 2.4 |
| Hot air shrinkage 180° C. | % | 1.8 | 1.8 |
| Loop tenacity | cN/tex | 31.4 | 28.5 |
| Seam strength (n10) | daN | 38.9 (35.6–41.2) | 34.5 (32.3–37.6) |
| Sewing test of dyed thread:*) | | | |
| Sewn length | cm | 933 | 768 |

*) 4 plies of cotton twill (350 g/m$^2$; 5000 stitches/min; 4 stitches/cm; yarn tension 220 cN)

What is claimed is:

1. A sewing yarn comprising at least one filamentary core made of a polyester material and sheathed with fibers selected from the group consisting of vegetable, regenerated or synthetic origin and mixtures thereof in such a way that the core is virtually completely covered, wherein a) the polyester material of the core filaments has an average molecular weight corresponding to a relative solution viscosity determined on solutions of 1 g of polyester in 100 ml of dichloroacetic acid at 25° C. of at least 1.9, b) the core has a specific strength of at least 60 cN/tex, and c) the core has a breaking extension less than 20% and wherein the sewing yarn has a seam length to rupture of more than 800 cm in a sewing test under aggravated conditions, said sewing test being carried out on four plies of cotton twill of basis weight 350 g/m$^2$ with 5000 stitches/min, four stitches/cm, a sewing tension of 220 cN and with sewing in the forward direction.

2. The sewing yarn of claim 1, wherein the polyester material of the core is polyethylene terephthalate or a copolyester that contains recurring ethylene terephthalate units.

3. The sewing yarn of claim 1, wherein the polyester material of the core filaments has an average molecular weight corresponding to a relative solution viscosity determined on solutions of 1 g of polyester in 100 ml of dichloroacetic acid at 25° C. of from 1.9 to 2.4.

4. The sewing yarn of claim 1, wherein the core has a specific strength of from 65 to 90 cN/tex.

5. The sewing yarn of claim 1, wherein the sheathed fibers are cotton.

6. The sewing yarn of claim 1 having a seam length to rupture of from 875 to 1050 cm in a sewing test under aggravated conditions.

7. The sewing yarn of claim 1, having a tenacity of more than 40 cN/tex.

8. The sewing yarn of claim 7, having a tenacity of 42 to 46 cN/tex.

9. The sewing yarn of claim 1, having a loop tenacity of more than 29 cN/tex.

10. The sewing yarn of claim 9, having a loop tenacity of 30 to 34 cN/tex.

11. The sewing yarn of claim 1, having an extension under a load of 300 cN of 2.8 to 3.2%.

12. The sewing yarn of claim 1, wherein the filamentary core comprises two mutually twisted cores each sheathed with fibers selected from the group consisting of vegetable, regenerated or synthetic and mixtures thereof in such a way the core filaments are virtually completely covered.

13. The sewing yarn of claim 1, wherein the weight ratio of the filamentary core to the sheathing fibers is from 30:70 to 50:50.

14. The sewing yarn of claim 1, wherein the core filaments have a linear density of 2 to 10 dtex, and the sheathing fibers are polyester fibers having a linear density of 1 to 2 dtex.

* * * * *